United States Patent [19]

Wong

[11] 4,134,494

[45] Jan. 16, 1979

[54] COMBINATION STRAW AND STIRRER

[76] Inventor: Woon-Tong Wong, 14 Upton St., Boston, Mass. 02118

[21] Appl. No.: 763,984

[22] Filed: Jan. 31, 1977

[51] Int. Cl.[2] ..... B65D 85/54; F25D 3/00

[52] U.S. Cl. ..... 206/216; 62/293; 215/1 A; 426/85

[58] Field of Search ..... 206/216, 217, 218, 525; 229/7 S; 215/1 A; 239/33; 62/293; 426/85

[56] References Cited

U.S. PATENT DOCUMENTS

| | | | |
|---|---|---|---|
| 1,254,115 | 1/1918 | Brand | 215/1 A |
| 2,036,706 | 4/1936 | Law | 426/85 |
| 2,120,201 | 6/1938 | Fisk | 62/293 |
| 2,713,543 | 7/1955 | Peters | 426/85 |
| 2,975,925 | 3/1961 | Chambers | 220/90.2 |

FOREIGN PATENT DOCUMENTS

| | | | |
|---|---|---|---|
| 1365346 | 5/1964 | France | 62/293 |

*Primary Examiner*—William T. Dixson, Jr.
*Attorney, Agent, or Firm*—Wolf, Greenfield & Sacks

[57] ABSTRACT

A combination straw and stirrer having an enlarged central section. The hollow structure is sealed by plugs at both ends to form a drink stirrer. When the plugs are removed the structure functions as a straw and the hollow structure may also be filled with water or other liquid and frozen to form a self-contained ice cooler.

1 Claim, 2 Drawing Figures

COMBINATION STRAW AND STIRRER

SUMMARY AND BACKGROUND OF THE INVENTION

The present invention pertains to a combination straw and stirrer. The structure of this invention may also be used as a self-contained ice cooler by filling the structure and freezing it.

Accordingly, one object of the present invention is to provide a combination straw and stirrer.

Another object of the present invention is to provide a combination straw and stirrer that is hollow and may be filled with a liquid and frozen to form a self-contained ice cooler.

A further object of the present invention is to provide the combination ice stirrer and straw that is safe, sanitary and reuseable.

Still a further object of the present invention is to provide a stirrer and straw that may also be used as an ice cube cooler for cooling drinks without diluting them.

To accomplish the foregoing and other objects of this invention there is provided a hollow structure which may be constructed of glass or a plastic material but which is preferably constructed of plastic. This hollow structure has an enlarged area between its ends which may have a spherical shape or any other shape. At either end there is preferably a tubular section integrally connecting with the enlarged central area. The hollow structure is sealed by plugs at both ends. When the structure is to be used as a straw the ends are not plugged, of course. When the structure is to be used as a stirrer the ends may be plugged or not plugged. The hollow structure may also be filled with a liquid such as water and be frozen with the plug secured at both ends. The structure can then be used in a drink for cooling the drink. When the ice within the hollow structure melts it can be frozen again any number of times.

BRIEF DESCRIPTION OF THE DRAWINGS

Numerous other objects, features and advantages of the invention will now become apparent upon a reading of the following detailed description taken in conjunction with the accompanying drawings in which.

DETAILED DESCRIPTION

Figure 2:
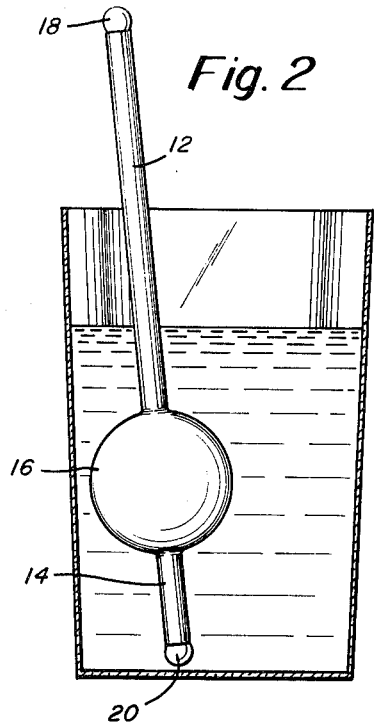
FIG. 2 shows the straw and stirrer within a vessel containing a liquid such as a cold drink.
Figure 1:
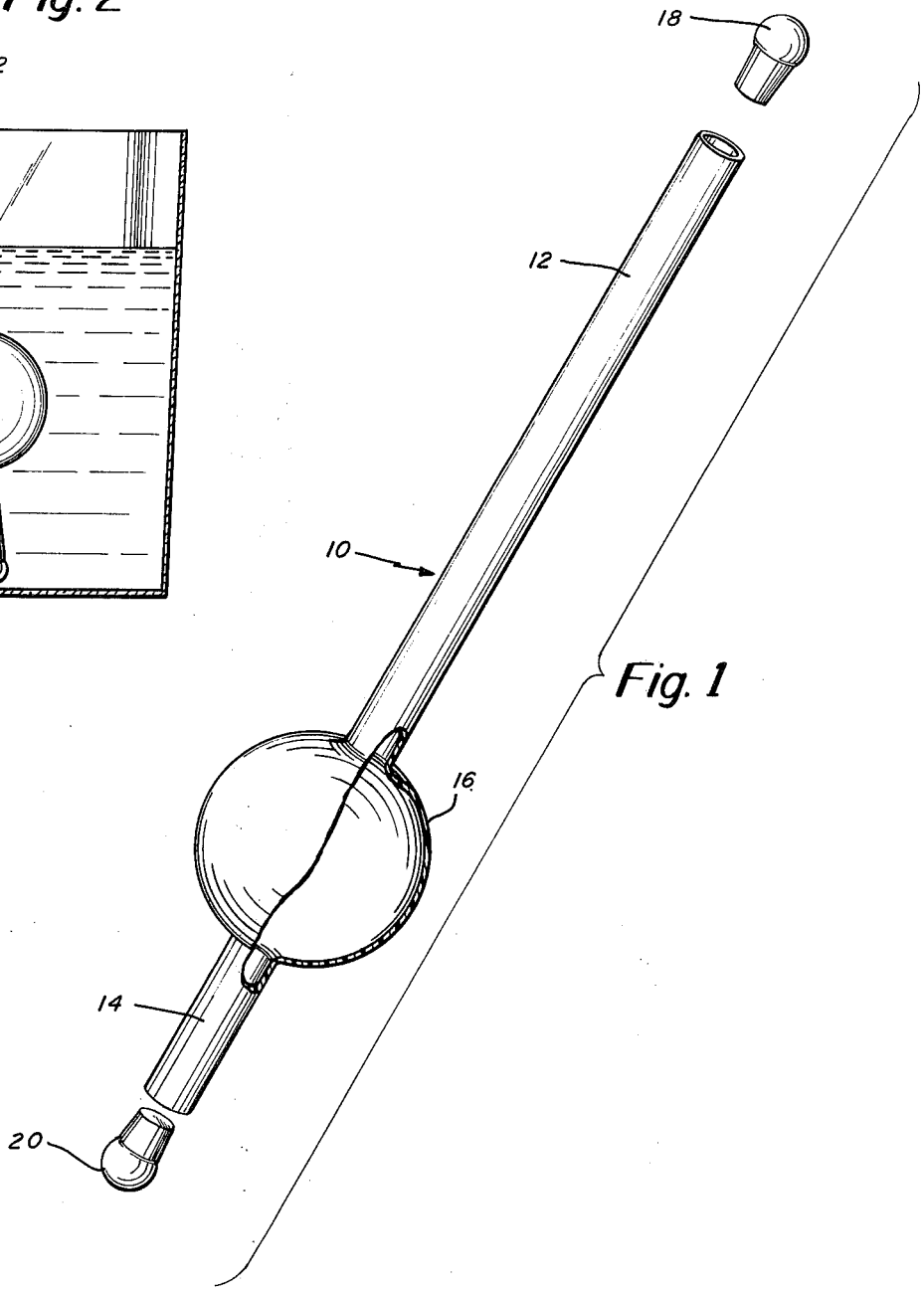
FIG. 1 is a perspective view of the combination straw and stirrer partially cut away to show the internal structure of the device.

The drawings show a hollow structure 10 which forms the combination straw and stirrer. The structure 10 includes a hollow circular tube end 12 and another hollow circular tube end 14 integrally joined at an enlarged center area 16 which in the disclosed embodiment has a spherical shape. The hollow structure may be constructed of glass but is preferably constructed of a plastic material such as a polyethylene. There are plugs 18 and 20 which seal the outer ends of tubular sections 12 and 14. The hollow structure is preferably made by a blow molding technique. The central section

16 may be constructed in many different forms such as in the shape of an item, person or animal. The hollow structure is preferably constructed of a clear plastic material that could also be constructed in various colors.

When the hollow structure is used as a straw the plugs 18 and 20, of course, are removed. When the structure is to be used as a stirrer the plugs may either be removed or may be inserted in either end. To use as a drink cooler, the plugs are removed from the ends of the hollow structure and the structure is boiled for sterilization purposes. The structure is then filled with boiled but cooled water to fill about 80% of the hollow structure from a volume standpoint. The structure is then totally sealed with both plugs and placed into a freezer for freezing the liquid within the hollow structure. When this is to be used, the hollow structure can be put into a drink and the frozen contents of the hollow structure will tend to cool the drink yet without diluting the contents of the drink.

The structure of this invention can also be used for serving alcoholic beverages. For example, the structure could be dimensioned so as to hold a predetermined volume of liquor such as one or two ounces. With the liquor contained within the hollow structure, the device can then be served along with the accompanying liquid comprising the drink with the contents of the hollow structure then being poured into the contents of the glass. In an alternate arrangement the plugs 18 and 20 may be replaced by sealing caps.

Having described one embodiment of the present invention it should now be obvious that other arrangements of the invention are contemplated as falling within the scope of this invention.

What is claimed is:

1. A combination straw, stirrer and liquid holder comprising;

an elongated hollow plastic structure defined only by an annular wall having an enlarged wall section and two elongated straw-like end wall sections extending from and integrally contiguous with the enlarged wall section, said end wall sections having like circular cross-sections with one of said sections being longer than the other section and with the perimeter of the enlarged wall section substantially larger than that of the end wall sections, said enlarged wall section having a volume greater than either end wall section with all hollow sections having fluid-communicating contiguous volumes, said end wall sections extending from the enlarged wall section at diametrically opposite sides thereof so that said end wall sections are in linear alignment having opposite facing end openings, said end wall sections each being at least of a length on the order of the length of the enlarged wall section, said volume of said hollow structure adapted to receive a liquid filling less than the total volume thereof, and plug means releasably sealing the end openings.

* * * * *